US007258155B2

(12) United States Patent
Spadone et al.

(10) Patent No.: US 7,258,155 B2
(45) Date of Patent: Aug. 21, 2007

(54) INGOT MOULD FOR QUENCHING METALS AND INGOTS THUS OBTAINED

(75) Inventors: Thomas Spadone, Sao Paulo (BR); Robert Rey-Flandrin, Saint Etienne de Crossey (FR)

(73) Assignee: Aluminium Pechiney, Paris (FR)

( * ) Notice: Subject to any disclaimer, the term of this patent is extended or adjusted under 35 U.S.C. 154(b) by 0 days.

(21) Appl. No.: 10/543,419

(22) PCT Filed: Feb. 17, 2004

(86) PCT No.: PCT/FR2004/000357

§ 371 (c)(1),
(2), (4) Date: Dec. 8, 2005

(87) PCT Pub. No.: WO2004/073904

PCT Pub. Date: Sep. 2, 2004

(65) Prior Publication Data

US 2006/0137847 A1 Jun. 29, 2006

(30) Foreign Application Priority Data

Feb. 18, 2003 (FR) ..... 03 01912

(51) Int. Cl.
*B22D 5/00* (2006.01)

(52) U.S. Cl. ..... 164/271; 164/412; 266/227

(58) Field of Classification Search ..... 164/271, 164/6, 412; 266/227
See application file for complete search history.

(56) References Cited

U.S. PATENT DOCUMENTS 1,410,417 A 3/1922 Simon et al.
1,745,475 A 2/1930 Coburn
5,019,455 A * 5/1991 Downie et al. ..... 428/584
6,006,821 A * 12/1999 Haun et al. ..... 164/495
6,179,042 B1 * 1/2001 Perdue et al. ..... 164/483
2002/0170700 A1 * 11/2002 Yanagimoto et al. ..... 164/455

FOREIGN PATENT DOCUMENTS

DE 809948 8/1951
FR 2678185 12/1992

* cited by examiner

*Primary Examiner*—Len Tran
(74) *Attorney, Agent, or Firm*—Dennison, Schultz & MacDonald

(57) ABSTRACT

An ingot mold for metals which is intended for the production of an ingot through the cooling and solidification of a liquid metal mass. The mold includes a wall which defines a base and an inner surface having a part S, known as the cooling surface, which can discharge all or part of the heat energy released by the metal mass during the cooling and solidification thereof. The cooling surface S includes at least one flat surface element Si which forms all or part of the base (4) of the ingot mold. There is also at least one point C on a plane Pi which is tangential to each surface element Si, such that all of the segments of a straight line D connecting every point R of the cooling surface S to point C are only located inside the mold. Further, the total area of surface elements Si is at least equal to 10% of the surface S. The ingot mold can be used to accelerate the production of ingots.

23 Claims, 5 Drawing Sheets

INGOT MOULD FOR QUENCHING METALS AND INGOTS THUS OBTAINED

This application is a filing under 35 USC 371 of PCT/FR2004/000357 filed Feb. 17, 2004.

FIELD OF THE INVENTION

This invention relates to casting of non-ferrous metals, and particularly aluminum and its alloys. In particular, it relates to metal ingots and particularly stackable ingots, and the ingot moulds used to obtain them.

DESCRIPTION OF RELATED ART

Metal ingots are produced by pouring liquid metal into an ingot mould with a specific shape. The liquid metal cools, solidifies and produces an ingot with the same shape as the inside volume of the ingot mould.

Most ingots have a shape that facilitates storage by stacking and handling of the stacks thus obtained. The stacks may be stabilised by one or several straps. In general, ingots are also provided with means of limiting the volume of stacks and for self-stabilising them. These means are typically interlocking means such as projecting elements (studs, bosses, pads, etc.) and recessed elements (notches, grooves, etc.) that cooperate so that each ingot may be held in place by adjacent ingots. Several shapes of ingot and ingot moulds have been proposed such as those described in Pechiney's French patent FR 1 310 651 (corresponding to U.S. Pat. No. 3,161,477), American Magnesium Co.'s U.S. Pat. No. 3,570,664, Ormet Corp.'s U.S. Pat. Nos. 3,498,451 and 3,671,204, Intalco Aluminum Corp.'s French patent FR 2 068 802 (corresponding to U.K. patent application GB 1 315 134), the Soviet Union patent SU 1 065 076 taken out by the U.S.S.R. Institute of Scientific Research and Technical Studies for the aluminum, magnesium and electrodes industry, and Sollac's French application FR 2 678 185.

The rate of the ingot manufacturing process including cooling and solidification of ingots is a determining factor in the productivity of a foundry. Thus, dissipation of heat from the metal contained in ingot moulds in industrial metal ingot production systems is usually accelerated using a cooling fluid, typically water, that is brought into thermal contact with the outside surface of the ingot moulds. However due to the permanent increase in the production capacity of metal production plants, and particularly in electrolytic aluminium production plants, ingot manufacturing may become a step limiting the production of a plant. Consequently, a permanent search is made for solutions to accelerate manufacturing of ingots, while maintaining the quality of ingots obtained and the possibility of stacking them in a stable manner.

SUMMARY OF THE INVENTION

An object of the invention is a metal ingot mould designed for fabrication of ingots by cooling and solidification of a mass of liquid metal with an initial volume Vo, comprising an inside cooling surface S that will dissipate all or some of the heat energy released by the mass of liquid metal during cooling and solidification, and characterised in that the shape of the cooling surface S is such that when the volume Vo of metal contracts due to cooling and solidification, the metal remains in contact with at least 10% of the surface area S.

Preferably, the metal remains in contact with at least 15% of the surface area S and more preferably at least 20% of the surface area S.

In his search for solutions to the problem that arises with the invention, the applicant has observed that unexpectedly, the effective cooling time of ingots, from the pouring of the liquid metal into the ingot mould until the extraction of the solidified ingot, is actually significantly longer than predicted by estimates made from thermal calculations, and that the importance of this phenomenon depends very much on the shape of the ingot mould. The applicant then had the idea that the increased cooling time could largely be explained by a problem of thermal contact between the metal and the ingot mould and noted that unexpectedly, contraction of the metal during its solidification creates a slight separation between the ingot and the inside surface of the ingot mould at many locations. Although small, this separation creates an air film that significantly reduces heat exchanges between the ingot and the wall of the ingot mould. Heat exchanges then only take place over very small areas at the interface between the ingot and the ingot mould.

In one preferred embodiment of the invention, the metal ingot mould is characterised in that the cooling surface comprises at least one plane surface element Si preferably forming all or part of the bottom of the ingot mould, and in that there is at least one point C on a plane Ti tangent to the, or to each, surface element Si such that all straight line segments D connecting any point R on the cooling surface S to the point C pass only inside the ingot mould, and in that the total surface area of the surface element or elements Si is equal to at least 10% of the cooling surface area S.

Preferably, the total surface area of the surface element or elements Si is equal to at least 15% of the cooling surface area S, and even more preferably at least 20% of the cooling surface area S.

Another object of the invention is a metal ingot that could be obtained with an ingot mould according to the invention, comprising a moulded surface Sm and a rough surface Sb, and characterised in that the moulded surface Sm comprises at least one plane surface element Si, in that there is at least one point C on a plane Pi tangent to the, or to each, surface element Si such that all straight line segments D connecting any point R on the moulded surface Sm to the point C pass only inside the ingot, and in that the total surface area of the surface element or elements Si is equal to at least 10% of the moulded surface area Sm.

The moulded surface area Sm corresponds to the part of the total surface of the ingot that was formed by the ingot mould, namely the initial surface So. The remainder of the surface of the ingot or the rough surface Sb, typically corresponds to the upper part of the initial mass of liquid metal.

Preferably, the total surface area of the surface element or elements Si is equal to at least 15% of the moulded surface area Sm, and more preferably equal to at least 20% of the moulded surface area Sm.

Another object of the invention is the use of an ingot mould according to the invention for manufacturing of metal ingots.

Another object of the invention is a method for manufacturing metal ingots using an ingot mould according to the invention.

The invention is particularly suitable for manufacturing of non-ferrous metal ingots and particularly ingots made of aluminium, aluminium alloy, magnesium, magnesium alloy, zinc or zinc alloy.

The invention will be better understood after reading the attached Figures and the detailed description given below that describe a preferred embodiment.

DETAILED DESCRIPTION OF THE INVENTION

Figure 1:
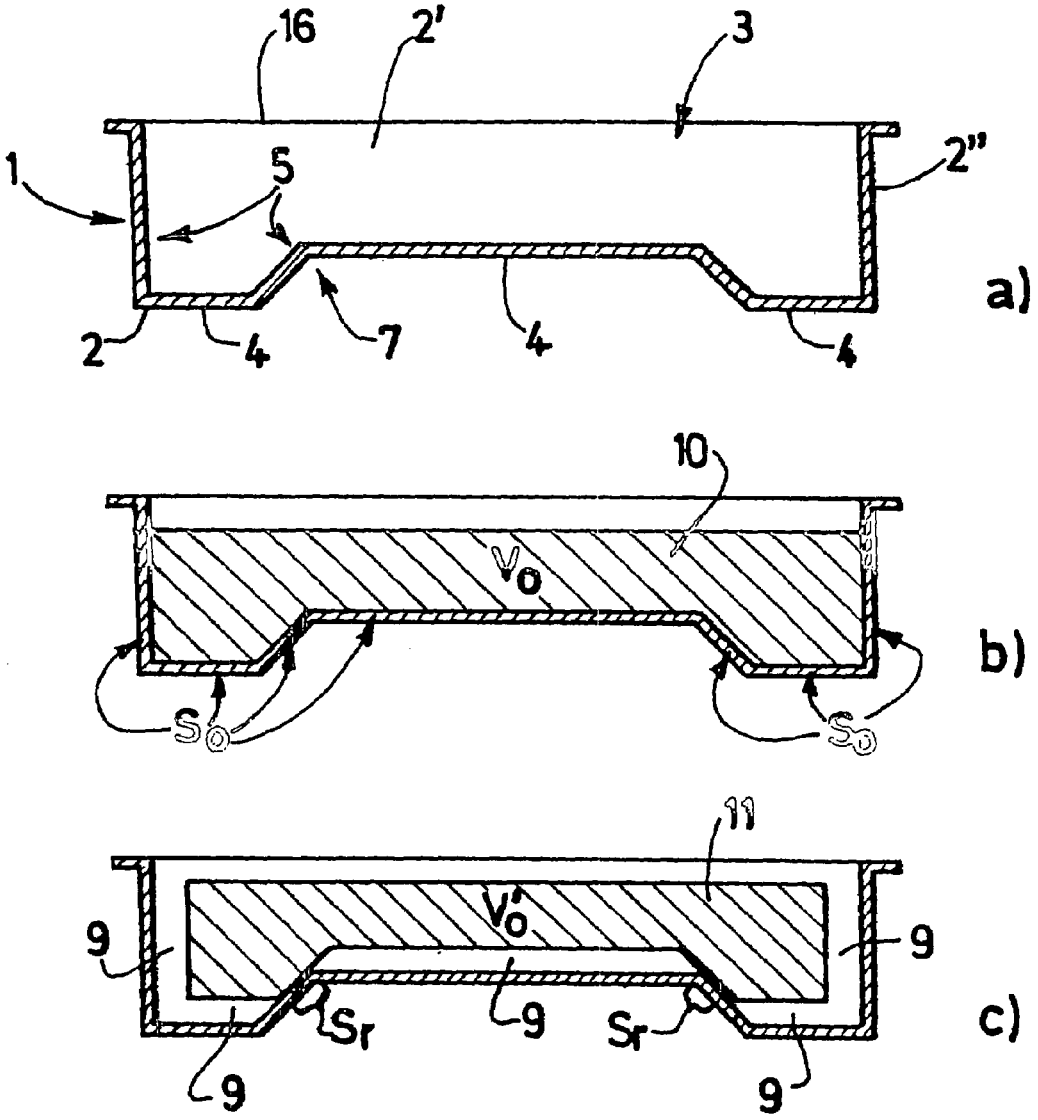
FIG.1 PRIOR ART
FIGS. 1 and 2 show longitudinal sectional views showing two typical ingot moulds according to prior art and the effect of contraction of the metal as it cools and solidifies.

As can be seen in the attached Figures, an ingot mould (1) typically comprises a wall (2) usually made of metal and/or a refractory material, and an opening (3) through which liquid metal can be poured into the ingot mould. The wall (2) defines a bottom (4), sidewalls (2') and end walls (2"). The wall (2) has an inner surface (5) and shape elements (6, 7, 8) that will apply a determined shape to the ingot. In particular, these shape elements produce ingot interlocking or handling elements.

Figure 2:
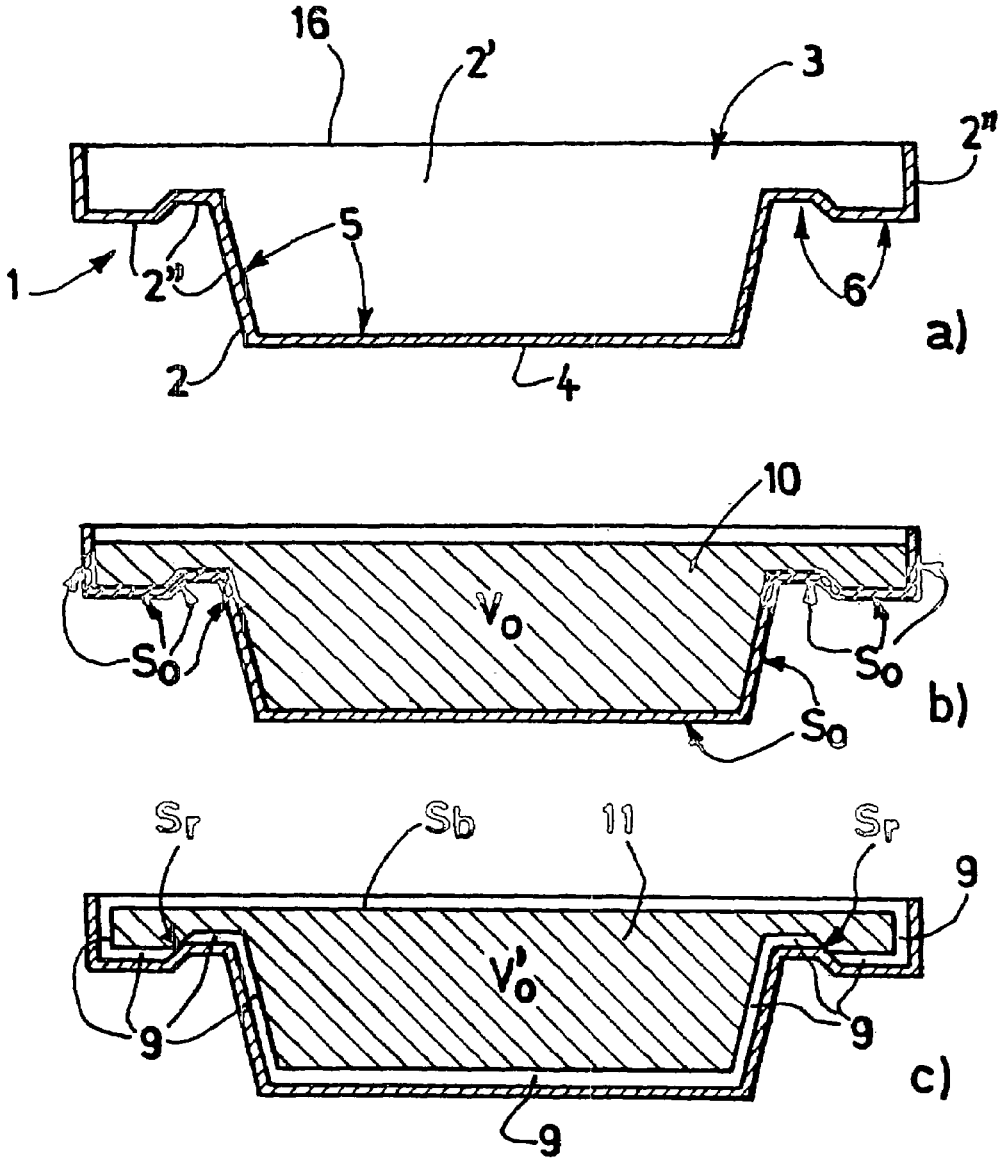
FIG.2 PRIOR ART

The liquid metal (10) initially fills a volume Vo and comes into contact with the wall (2) over a part So of the internal cooling surface S. The ratio between the area Ao of the surface So and the volume Vo of the liquid metal is then high, typically of the order of 0.5 $cm^{-1}$. During cooling and solidification, the metal contracts (occupying a volume Vo' smaller than Vo) and separates from the wall in several locations, thus forming air films (9). As shown in FIGS. 1 and 2, in ingot moulds according to prior art, the area Ar of the residual contact surface Sr is significantly smaller than the initial area Ao. The applicant estimates that the area of the residual surface obtained with ingot moulds according to prior art is significantly less than 10% of the initial area (typically of the order of 5%). Consequently, a small reduction in volume Vo will cause a considerable increase in the thermal resistance.

According to the invention, a large contact area can be maintained despite contraction of the metal, due to the use of an appropriate shape of the inside surface of the ingot mould. The shape is preferably such that when the volume Vo of metal contracts due to cooling and solidification, the metal remains in contact with at least 10% of the cooling surface area S.

In one preferred embodiment of the invention, the metal ingot mould (1) that will be used for manufacturing an ingot (11) by cooling and solidification of a mass of liquid metal (10), comprises a wall (2) and an opening (3), the said wall (2) defining a bottom (4) and an inside surface (5) of which a part S, called the cooling surface, can dissipate all or some of the heat energy released by the metal mass (10) during cooling and solidification, the said wall (2) comprising at least one shape element (6, 7, 8) that will form at least one interlocking element, one stacking element or one handling element on the ingot (11), and is characterised in that the cooling surface S comprises at least one plane surface element Si forming all or part of the bottom (4) of the ingot mould (1), in that there is at least one point C on a plane Pi tangent to the surface element, or to each surface element, Si such that all straight line segments D connecting any point R on the cooling surface S to point C pass only inside the ingot mould (1), and in that the total surface area of the surface element or elements Si is equal to at least 10% of the cooling surface area S.

In other words, the straight line segments D do not touch any other point on the surface S, except surface elements Si.

Preferably, the total surface area of the surface element or elements Si is equal to at least 15% of the surface S, and more preferably at least 20% of the surface S.

Figure 3:
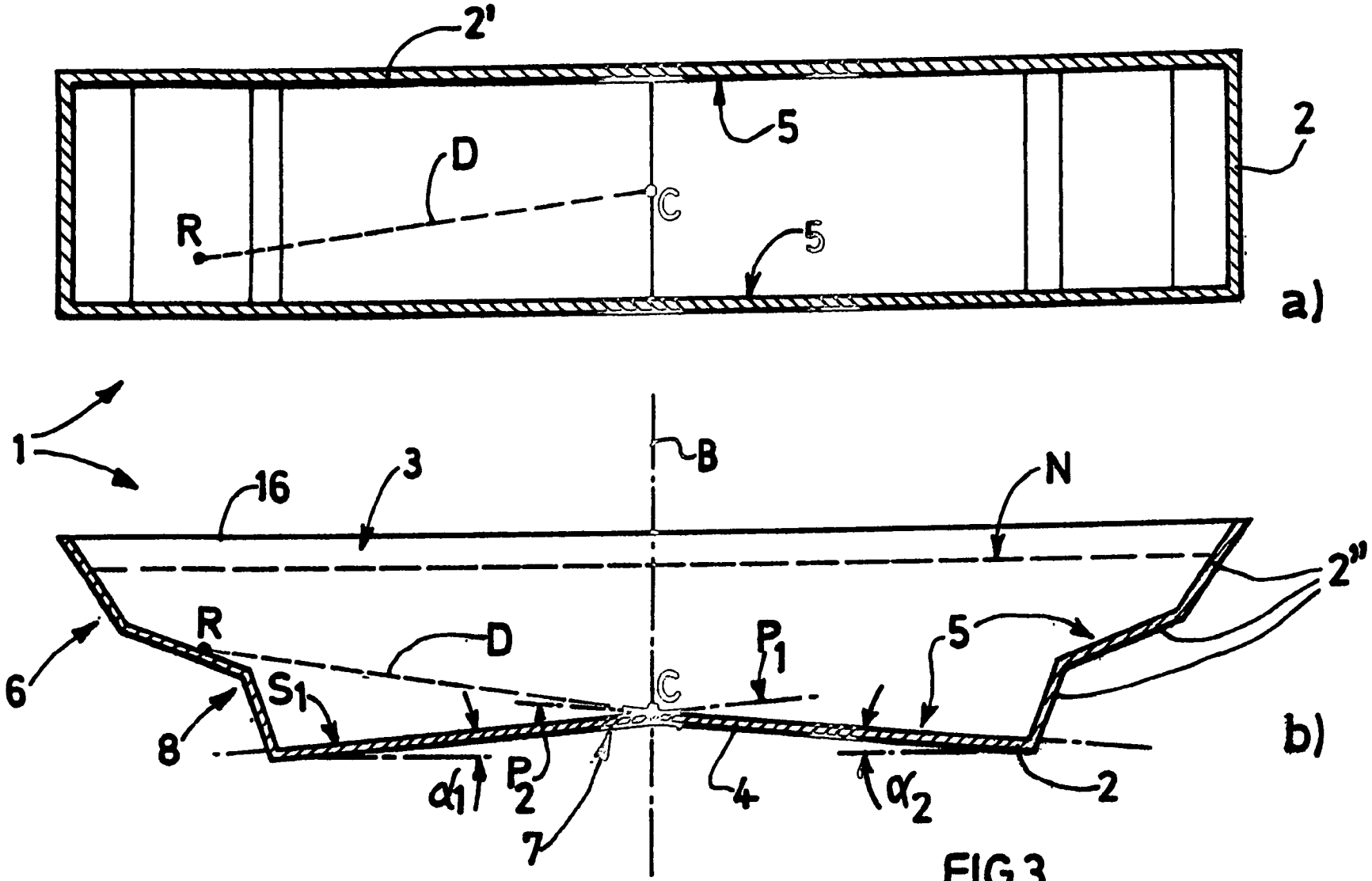
FIG. 3 shows an ingot mould according to the invention.
Figure 4:
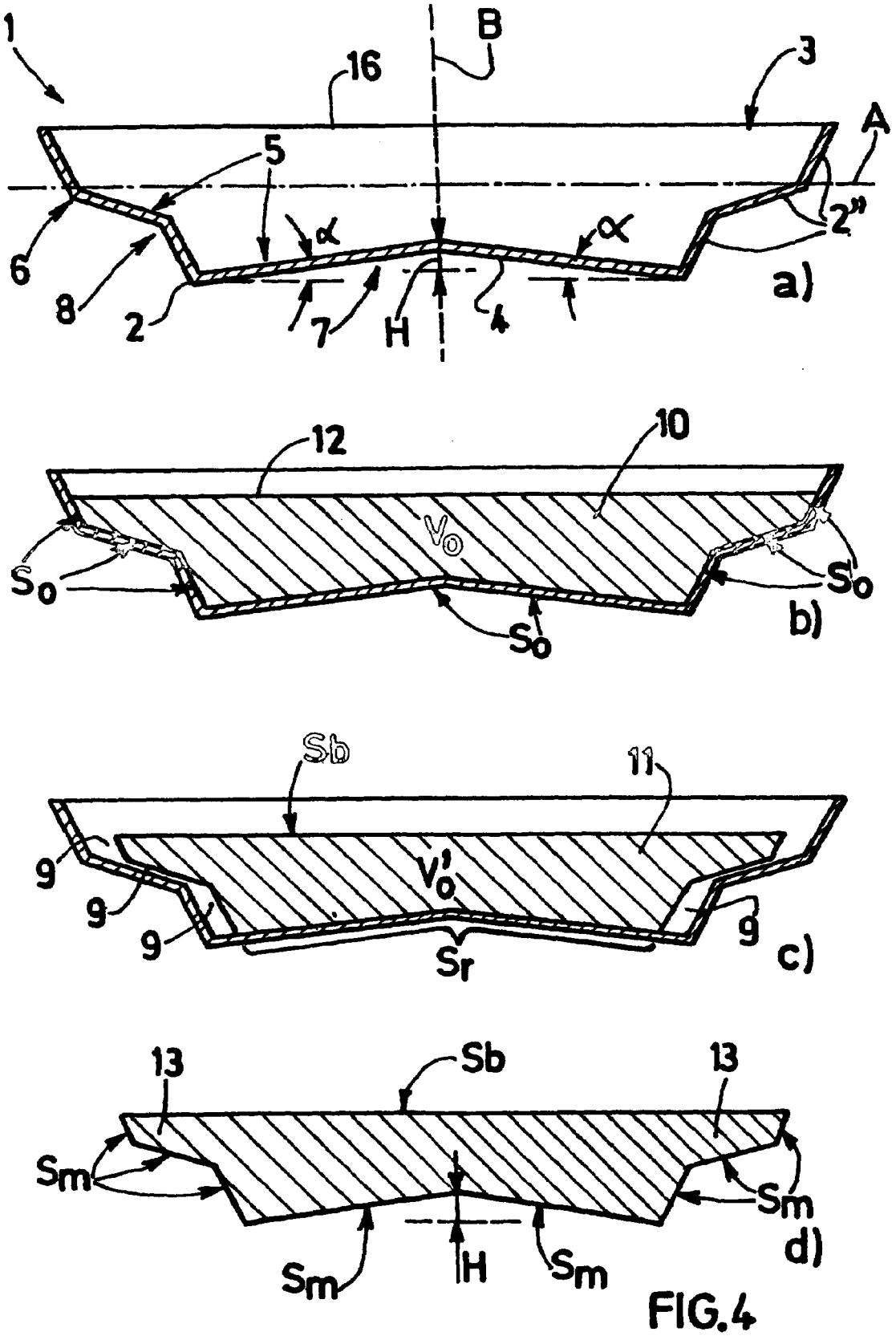
FIG. 4 shows an ingot mould according to the invention seen in a longitudinal sectional view, and the effect of contraction of the metal as it cools and solidifies.

The impact of contraction of the metal caused by cooling and solidification of the liquid metal (10) that is initially in contact with a part So of the cooling surface S may be visualized approximately as a homothetic contraction of the surface So by a relatively small quantity K from point C. In FIG. 4, it can be seen that in an ingot mould according to the invention, contraction does not generate any intersection between the contracted surface So' thus obtained and the initial surface So so that the area of each surface Si of the bottom (4) can be kept practically unchanged (in the case shown in FIG. 4, the bottom comprises two surfaces Si that are identified by marks $S_1$ and $S_2$ in FIG. 3). In fact, the homothetic contraction keeps the contracted surface So' in contact with the surface elements Si by sliding on their plane Pi. When there is more than one surface element Si, the point C is at the intersection of the corresponding planes P1, P2, . . . , as shown in FIG. 3.

The effect of gravitation is taken into account by the fact that the surface element(s) Si is (are) located at the bottom of the ingot mould. In practice, the point C is preferably such that the centre of mass of the contracted volume Vo' corresponding to the contracted surface So' is at the lowest possible point with respect to the normal direction of use of the ingot mould, in other words it is impossible to move the contracted surface So' vertically downwards without creating an intersection between So' and the inside surface (5) of the ingot mould. In other words, the proportional contraction leaves the contracted surface So' at the lowest gravitational level with respect to the direction of use of the ingot mould. The ingot moulds according to the invention can thus maintain a considerably greater residual contact surface than ingot moulds according to prior art.

The exact value of the quantity K called the "proportional transformation ratio" is not critical for operation of the invention, provided that it represents thermal contraction values obtained with metals. It is sufficient to use a proportional transformation ratio K less than about 1% to determine appropriate cooling surface shapes. Contractions in the metal volume from Vo to Vo' shown in the attached Figures have been deliberately exaggerated to better illustrate the principle of the invention.

Surface elements Si are advantageously at an angle $\alpha_i$ with respect to the normal initial level N of the liquid metal (10). The said level N is typically parallel to the outside edge (16) of the opening (3) of the ingot mould (1). The angle $\alpha_i$ is preferably less than 30° and more preferably less than 20° in order to optimise the volume of the ingot while releasing a space under it through which a strap can be passed when stacking the ingots obtained.

The cooling surface S normally comprises more than five distinct surface elements Si, namely at least two sidewalls (2'), two end walls (2") and a bottom (4), so as to form the shape elements (6, 7, 8, 14, 15). For example, the ingot mould shown in FIG. 3 comprises at least ten distinct surface elements (including the sidewalls (2')).

The ingot mould according to the invention typically comprises an even number of surface elements Si. The number of surface elements Si is preferably equal to 2 (as shown in FIGS. 3 and 4) in order to simplify its production and to more easily obtain a very large residual contact surface. The surface elements Si are preferably contiguous (as shown in FIG. 3) so as to maximise the residual contact surface.

Figure 5:
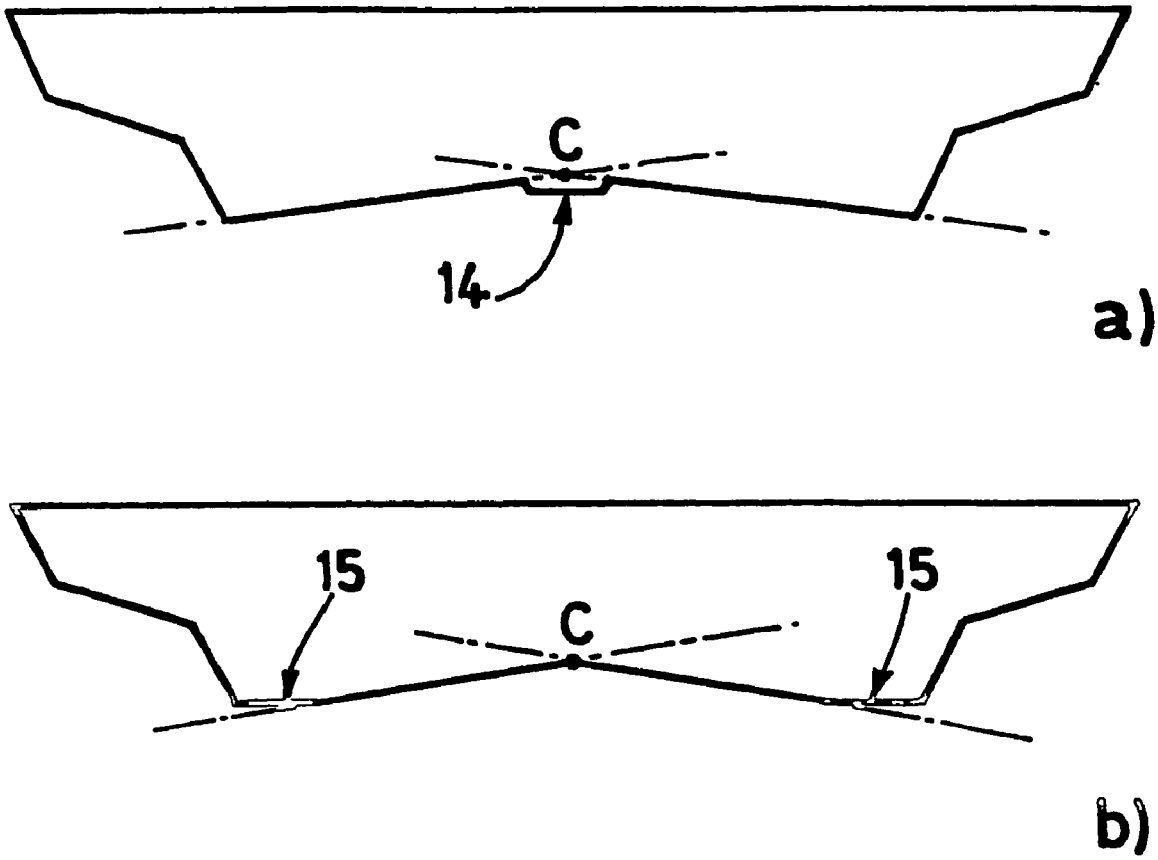
FIG. 5 shows profiles of ingot moulds according to variants of the invention.

FIG. 3 shows one embodiment of the invention which is particularly advantageous in which there are two surface elements Si denoted $S_1$ and $S_2$, that are not in the same plane and that intersect at point C. FIG. 5 shows variants of the invention in which the bottom (4) comprises additional shape elements (14, 15).

The surface elements Si may have different areas Ai and may be inclined at a different angle $\alpha_i$. In order to simplify the production and use of the ingot mould according to the invention, it advantageously has a principal axis A and a plane of symmetry B perpendicular to its principal axis A, and the point C is located in the plane of symmetry B. In this embodiment, the angle $\alpha_i$ is the same for surface elements Si arranged symmetrically. In this case, the outside edge (16) of the opening (3) of the ingot mould (1) is preferably approximately straight and perpendicular to plane B and the initial normal level N of the liquid metal (10) is approximately parallel to the said outside edge (16).

Preferably, none of the angles between the inside surface elements of the ingot mould is less than 90°, to avoid forming areas that would block the ingot in the ingot mould and would make extraction difficult.

Locking elements typically comprise projecting elements (studs, bosses, pads, etc.) and recessed elements (notches, grooves, etc.) that cooperate with each other so that each ingot can be retained by adjacent ingots. Stacking elements typically comprise projecting or recessed elements (such as depressions) so that ingots can be stacked in an optimum manner, and/or so that stack stabilisation such as straps can be placed. Handling elements typically include projecting and/or recessed elements that form gripping means such as "lugs" or handles.

Another object of the invention is a metal ingot (11) comprising a moulded surface Sm and a rough surface Sb, comprising at least one element chosen from among interlocking elements, stacking elements and handling elements, and characterised in that the moulded surface Sm comprises at least one plane surface element Si, in that there is at least one point C on a plane Pi tangent to the surface element or to each surface element Si such that all straight line segments D connecting any point R on the moulded surface Sm to point C pass only inside the ingot (11), and in that the total surface area of the surface element or elements Si is equal to at least 10% of the moulded surface area Sm.

Thus, like the case of the ingot mould according to the invention, a proportional contraction of the surface Sm by a quantity K determined with respect to point C, does not create any intersection between the contracted surface Sm' thus obtained and the moulded surface Sm.

Preferably, the total surface area of the surface element or elements Si is equal to at least 15% of the moulded surface Sm, and more preferably equal to at least 20% of the moulded surface Sm.

Each surface element Si is advantageously inclined by an angle $\alpha_i$ from the rough surface Sb of the ingot, which can optimise the volume of the ingot while releasing a space under the ingot around which a strap can be placed when stacking ingots. The angle $\alpha_i$ is preferably less than 30° and more preferably less than 20°. The applicant has noted that the free space thus obtained is particularly advantageous because it means that a strap made of a flexible material such as polyester can be used, that holds the stack in position very well when the ingots are stacked without risk of it wearing during handling of the stack. If this free space is not present, the strap can rub on the floor and wear by abrasion. It is usually sufficient for the depth H of the free space under the ingot obtained to be between 6 and 12 mm for an approximately 70 cm long ingot.

The ingot according to the invention typically includes an even number of surface elements Si preferably two surface elements Si to simplify its manufacturing. In this case, the two surface elements Si are typically contiguous.

In one advantageous embodiment of the invention, the ingot has a principal axis A and a plane of symmetry B perpendicular to its principal axis A, and the point C is in the plane of symmetry B. In this embodiment, the angle $\alpha_i$ is the same for surface elements Si arranged symmetrically. The number of surface elements Si is preferably equal to 2 (as shown in FIGS. 3 to 5). The surface elements Si are preferably contiguous (as shown in FIGS. 3 and 4).

In order to facilitate handling of ingots according to the invention, they preferably include handling elements (13), and typically two end elements called "lugs" as shown in FIG. 4.

The ingot according to the invention is typically a stackable ingot that may be obtained using the ingot mould according to the invention.

Another object of the invention is a method of manufacturing metal ingots in which a volume Vo of the liquid metal is poured into an ingot mould according to the invention, the ingot mould is subjected to a flow of cooling fluid (typically water) and the ingot is extracted after cooling and solidification of the metal.

The metal is typically aluminium, an aluminium alloy, magnesium, a magnesium alloy, zinc or a zinc alloy.

The invention can be used to obtain ingots free of bubbles and cracks caused by shrinkage of metal as it cools.

It also prevents ingots from getting blocked in the ingot mould by thermal contraction. Stripping of the ingots is made easier which also contributes to accelerating ingot manufacturing operations.

Tests

Comparative tests were carried out with metal ingot moulds similar to those shown in FIG. 2 (prior art) and FIG. 3 (invention). The metal was aluminium. The amount of cast metal was typically 23 and 28 kg.

The solidification times were more than 350 s for ingot moulds according to prior art and of the order of 335 s for ingot moulds according to the invention. The solidification times obtained with ingot moulds according to prior art were highly dispersed (standard deviation more than 30 s) whereas they were not very dispersed with ingot moulds according to the invention (standard deviation less than 3 sec). Ingots obtained with ingot moulds according to the invention were generally free of shrinkage and cracks.

The total inside surface of ingot moulds (including sidewalls (2')) according to prior art and according to the invention was about 2300 $cm^2$. The applicant estimates that the value of the residual contact surface area was about 5% of the total surface area for ingot moulds according to prior art and about 20% of the total surface area for ingot moulds according to the invention.

LIST OF DIGITAL MARKS

1 Metal ingot mould
2 Wall
2' Sidewalls

2" End walls
3 Opening
4 Bottom
5 Inside surface
6, 7, 8 Shape elements
9 Air films
10 Liquid metal
11 Ingot
12 Liquid metal free surface
13 Handling elements
14, 15 Shape elements
16 Outside edge of ingot mould opening

The invention claimed is:

1. Metal ingot mold for manufacture of an ingot by cooling and solidification of a mass of liquid metal, comprising a wall and an opening, the wall defining a bottom and an inside surface having a portion defined as a cooling surface S which can dissipate at least some of the heat energy released by the metal mass during cooling and solidification, the wall comprising at least one shape element that forms at least one interlocking element, stacking element or handling element on the ingot, the cooling surface S comprising at least one planar surface element Si forming at least a part of the bottom of the ingot mold, each said planar surface element Si having a planar tangent Pi thereto with at least one point C on tangent Pi such that all straight line segments D connecting any point R on the cooling surface S to point C pass only inside the ingot mold, and the total surface area of the at least one surface element Si being equal to at least 10% of the cooling surface area S.

2. Ingot mold according to claim 1, wherein the total surface area of the at least one surface element Si is equal to at least 15% of the cooling surface S.

3. Ingot mold according to claim 1, wherein the total surface area of the at least one surface element Si is equal to at least 20% of the cooling surface S.

4. Ingot mold according to claim 1, wherein each surface element Si is inclined by an angle $\alpha_i$ from an initial normal level N of the liquid metal.

5. Ingot mold according to claim 4, wherein the angle $\alpha_i$ is less than 30°.

6. Ingot mold according to claim 5, wherein angle $\alpha_i$ is less than 20°.

7. Ingot mold according to claim 1, including an even number of surface elements Si.

8. Ingot mold according to claim 7, including two surface elements Si.

9. Ingot mold according to claim 8, wherein the two surface elements Si are contiguous.

10. Ingot mold according to claim 1, comprising a principal axis A and a plane of symmetry B perpendicular to the principal axis A, wherein the point C is located in the plane of symmetry B.

11. Metal ingot comprising a molded surface Sm and a rough surface Sb, comprising at least one element selected from the group consisting of interlocking elements, stacking elements and handling elements, the molded surface Sm comprising at least one planar surface element Si, each said planar surface element Si having a planar tangent Pi thereto with at least one point C thereon such that all straight line segments D connecting any point R on the molded surface Sm to point C pass only inside the ingot, and the total surface area of the at least one surface element Si is equal to at least 10% of the molded surface area Sm.

12. Ingot according to claim 11, wherein the total surface area of the at least one surface element Si is equal to at least 15% of the molded surface Sm.

13. Ingot according to claim 12, wherein the total surface area of the at least one surface element Si is equal to at least 20% of the molded surface Sm.

14. Ingot according to claim 11, wherein each surface element Si is inclined by an angle $\alpha_i$ from the rough surface Sb of the ingot.

15. Ingot according to claim 14, wherein the angle $\alpha_i$ is less than 30°.

16. Ingot according to claim 15, wherein the angle $\alpha_i$ is less than 20°.

17. Ingot according to claim 11, including an even number of surface elements Si.

18. Ingot according to claim 17, including two surface elements Si.

19. Ingot according to claim 18, wherein the two surface elements Si are contiguous.

20. Ingot according to claim 11, comprising a principal axis A and a plane of symmetry B perpendicular to the principal axis A, wherein the point C is located in the plane of symmetry B.

21. Method for manufacturing metal ingots comprising pouring a volume Vo of liquid metal into an ingot mold according to claim 1, subjecting the ingot mold to a flow of cooling fluid and extracting the ingot after cooling and solidification of the metal.

22. Method according to claim 21, wherein the metal is a non-ferrous metal.

23. Method according to claim 22, wherein the non-ferrous metal is selected from the group consisting of aluminum, aluminum alloys, magnesium, magnesium alloys, zinc and zinc alloys.

* * * * *